US011076462B2

(12) United States Patent
Crockett

(10) Patent No.: US 11,076,462 B2
(45) Date of Patent: Jul. 27, 2021

(54) REMOTE COUNTING OF SERIALLY CONNECTED COMPONENTS USING A CONTROLLER

(71) Applicant: Toshiba Global Commerce Solutions Holdings Corporation, Tokyo (JP)

(72) Inventor: Timothy W. Crockett, Raleigh, NC (US)

(73) Assignee: Toshiba Global Commerce Solutions Holdings Corporation, Tokyo (JP)

( * ) Notice: Subject to any disclaimer, the term of this patent is extended or adjusted under 35 U.S.C. 154(b) by 15 days.

(21) Appl. No.: 16/661,639

(22) Filed: Oct. 23, 2019

(65) Prior Publication Data

US 2021/0127465 A1 Apr. 29, 2021

(51) Int. Cl.

| | |
|---|---|
| ***H05B 45/20*** | (2020.01) |
| ***H05B 45/40*** | (2020.01) |
| ***H05B 47/165*** | (2020.01) |
| ***H05B 45/54*** | (2020.01) |

(52) U.S. Cl.

CPC ..... *H05B 45/20* (2020.01); *H05B 45/40* (2020.01); *H05B 45/54* (2020.01); *H05B 47/165* (2020.01)

(58) Field of Classification Search

CPC ..... H05B 45/10; H05B 45/20; H05B 45/40; H05B 45/54; H05B 45/58; H05B 47/10; H05B 47/16; H05B 47/165

See application file for complete search history.

(56) References Cited

U.S. PATENT DOCUMENTS

| | | | | |
|---|---|---|---|---|
| 3,835,456 | A | 9/1974 | Angelle et al. | |
| 5,184,114 | A | 2/1993 | Brown | |
| 5,894,362 | A | 4/1999 | Onaka et al. | |
| 5,990,802 | A | 11/1999 | Maskeny | |
| 6,522,412 | B2 | 2/2003 | Norita et al. | |
| 6,777,891 | B2 | 8/2004 | Lys et al. | |
| 7,023,232 | B2 | 4/2006 | Yano et al. | |
| 7,855,708 | B2 | 12/2010 | Ruby et al. | |
| 7,957,933 | B2 | 6/2011 | Kitsunai et al. | |
| 8,492,983 | B1 | 7/2013 | Berg et al. | |
| 8,635,035 | B2 | 1/2014 | De Oto et al. | |
| 8,947,407 | B2 | 2/2015 | Williams et al. | |
| 8,994,276 | B2 * | 3/2015 | Recker | H05B 47/19 315/160 |
| 8,994,799 | B2 | 3/2015 | Ganick et al. | |
| 9,655,217 | B2 * | 5/2017 | Recker | H05B 47/16 |
| 2003/0057886 | A1 * | 3/2003 | Lys | F21S 4/10 315/291 |

(Continued)

*Primary Examiner* — Amy Cohen Johnson
*Assistant Examiner* — Syed M Kaiser
(74) *Attorney, Agent, or Firm* — Patterson + Sheridan, LLP

(57) ABSTRACT

A system that includes a plurality of serially connected light emitting diodes (LEDs), a latch circuit, and a controller including logic is disclosed. A first plurality of bits is transmitted from the controller to a first LED of the plurality of serially connected LEDs. The plurality of serially connected LEDs includes the first LED, coupled to the controller, and a last LED coupled to the latch circuit. The controller determines that the latch circuit is set. The latch circuit is set based on an output of the last LED after the transmitting the first plurality of bits. The number of active LEDs in the plurality of serially connected LEDs is identified, based on determining that the latch circuit is set.

20 Claims, 6 Drawing Sheets

(56) References Cited

U.S. PATENT DOCUMENTS

| | | | | |
|---|---|---|---|---|
| 2009/0051629 | A1* | 2/2009 | Price | H05B 45/10 345/82 |
| 2012/0081009 | A1* | 4/2012 | Shteynberg | H05B 45/46 315/122 |
| 2013/0082604 | A1* | 4/2013 | Williams | H05B 45/50 315/130 |
| 2013/0099681 | A1* | 4/2013 | Williams | H05B 45/347 315/185 R |
| 2013/0214699 | A1* | 8/2013 | Jonsson | F21V 23/04 315/297 |
| 2014/0132154 | A1* | 5/2014 | Fried | F21V 33/0008 315/76 |
| 2014/0265871 | A1* | 9/2014 | Ku | H05B 47/175 315/152 |
| 2014/0268881 | A1* | 9/2014 | Ku | F21V 23/04 362/642 |
| 2014/0361696 | A1* | 12/2014 | Siessegger | H01L 27/156 315/186 |
| 2015/0231408 | A1* | 8/2015 | Williams | A61N 5/06 607/88 |
| 2016/0323972 | A1* | 11/2016 | Bora | F21V 7/00 |
| 2017/0223807 | A1* | 8/2017 | Recker | H02J 13/0017 |
| 2017/0311397 | A1* | 10/2017 | Hsia | F21K 9/27 |
| 2017/0367166 | A1* | 12/2017 | Ihara | H05B 47/19 |
| 2019/0335551 | A1* | 10/2019 | Williams | H05B 47/105 |

* cited by examiner

REMOTE COUNTING OF SERIALLY CONNECTED COMPONENTS USING A CONTROLLER

BACKGROUND

The present disclosure relates to remote counting of serially connected components, and more specifically, to remote counting for serially connected light emitting diodes (LEDs) using a controller.

A variety of electrical components can be connected serially in a strip. For example, a series of LEDs can be connected in an LED light strip. Remotely counting the number of LEDs in a serially connected LED strip can be useful for many reasons. For example, many checkout areas at retail stores (e.g., checkout lanes and self-checkout systems) use serially connected strips of LEDs to illuminate and identify components in the point of sale (POS) system. Remotely counting the number of LEDs in a serially connected LED strip can be used to distinguish between different strips, can be used to identify missing LEDs, and can be used to identify malfunctioning LEDs.

SUMMARY

Embodiments disclosed herein include a method. The method includes transmitting a first plurality of bits from a controller to a first light emitting diode (LED) of a plurality of serially connected LEDs, the plurality of serially connected LEDs including. the first LED coupled to the controller and a last LED coupled to a latch circuit. The method further includes determining, using the controller, that the latch circuit is set. The latch circuit is set based on an output of the last LED after the transmitting the first plurality of bits. The method further includes identifying a first number of active LEDs in the plurality of serially connected LEDs based on the determining that the latch circuit is set.

Embodiments disclosed herein further include a system. The system includes a plurality of serially connected light emitting diodes (LEDs), a latch circuit, and a controller including logic configured to perform an operation. The operation includes transmitting a first plurality of bits from the controller to a first LED of the plurality of serially connected LEDs, the plurality of serially connected LEDs including the first LED coupled to the controller and a last LED coupled to the latch circuit. The operation further includes determining, using the controller, that the latch circuit is set. The latch circuit is set based on an output of the last LED after the transmitting the first plurality of bits. The operation further includes identifying a first number of active LEDs in the plurality of serially connected LEDs based on the determining that the latch circuit is set.

Embodiments disclosed herein further include a computer program product for counting serially connected light emitting diodes (LEDs), the computer program product including a computer-readable storage medium having computer-readable program code embodied therewith, the computer-readable program code executable by one or more computer processors to perform an operation. The operation includes transmitting a first plurality of bits from a controller to a first LED of a plurality of serially connected LEDs, the plurality of serially connected LEDs including the first LED coupled to the controller and a last LED coupled to a latch circuit. The operation further includes determining, using the controller, that the latch circuit is set. The latch circuit is set based on an output of the last LED after the transmitting the first plurality of bits. The operation further includes identifying a first number of active LEDs in the plurality of serially connected LEDs based on the determining that the latch circuit is set.

DETAILED DESCRIPTION

Figure 1:
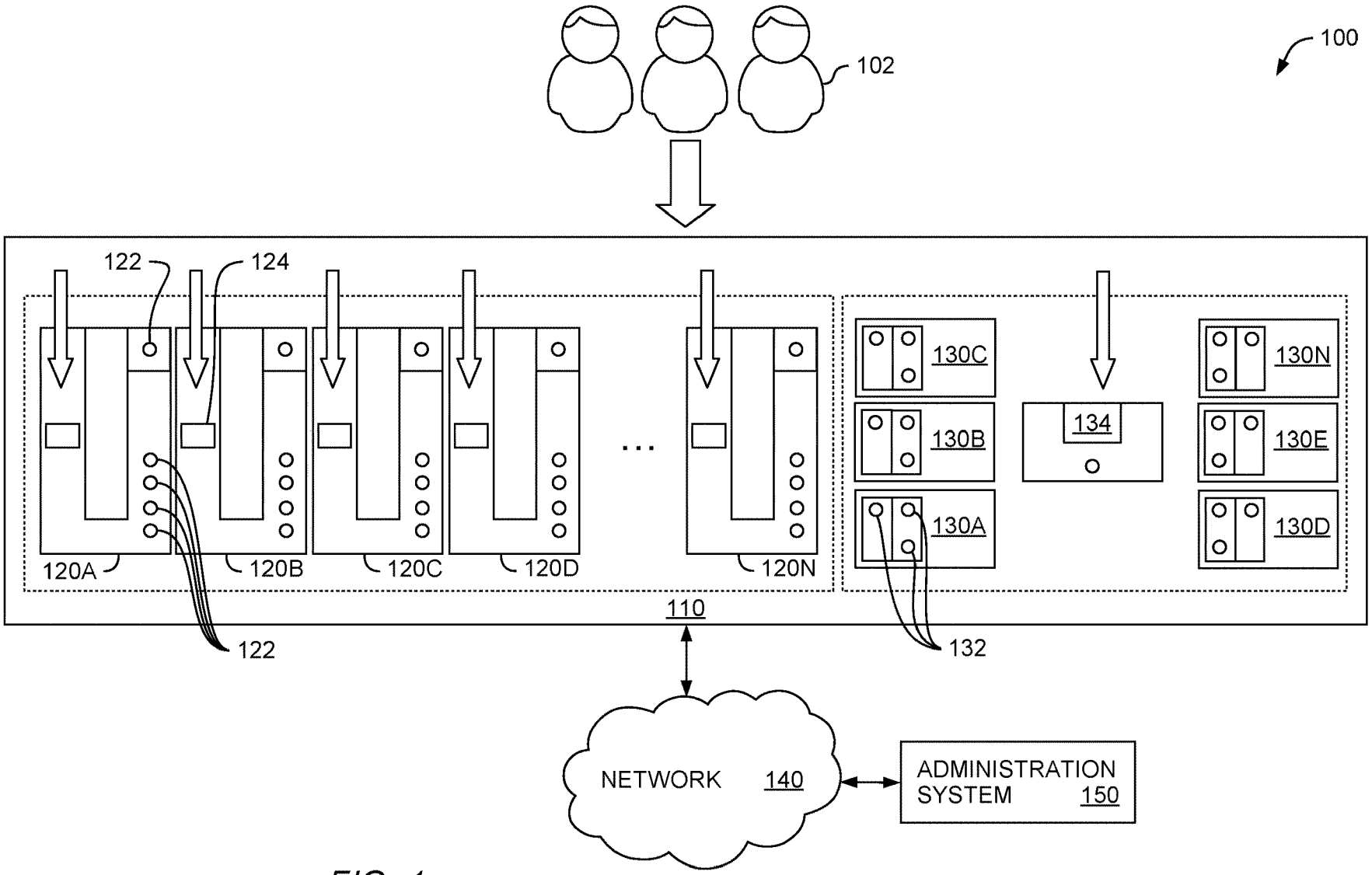
FIG. 1 illustrates example checkout areas including serially connected strips of LEDs, according to one embodiment.

As discussed above, a variety of electrical components can be connected serially in a strip. For example, light emitting diodes (LEDs) can be connected serially in a strip for a checkout area in a retail environment. Manned checkout and self-checkout areas, including point of sale (POS) systems, can include serially connected LED strips to illuminate various aspects of the checkout areas and POS systems. These LED strips can provide guidance to customers and employees, focus customer or employee attention on particular parts of the checkout areas, provide safety lighting, etc.

Remotely diagnosing problems with these serially connected LED strips can be difficult. For example, a retail store could have a back office (or central office) administration system that monitors the checkout area and detects problems. Because this system is remotely located, an administrator cannot simply look at the LED strips to diagnose any problems. Further, employees tasked with assisting with the checkout area may not have the training or expertise to identify and diagnose problems.

One more techniques disclosed herein relate to counting serially connected electrical components in a strip (e.g., a strip of LEDs). By counting the number of active LEDs (or other electronic components), and comparing it with an expected number of active LEDs for a given LED strip, a remote administrator can diagnose problems.

For example, a given checkout area might have multiple LED strips intended to be plugged into different areas. An employee could mistakenly plug one or more of the strips into the wrong area, resulting in incorrect LED placement and lighting. By determining the number of active LEDs in each strip, a remote administrator can identify this mistake and can provide guidance to the employee to fix the problem. As another example, an LED strip might have one or more LEDs that have stopped functioning. A remote lighting controller could identify a bad LED by detecting a lack of feedback (e.g. a count of MAX+1 as discussed below with regard to FIG. 4), and could provide guidance to provide new LEDs or fix malfunctioning LEDs.

Further, one or more techniques disclosed herein can use a controller to remotely count serially connected LEDs without the use of interrupts. In one embodiment, one could use a software interrupt to be triggered by the last LED's output in a strip to identify the malfunction of an LED. For example, LEDs in a strip can be fed by an output pin of a controller, and if the interrupt does not occur the strip is faulted. This can be used to identify and signal the pass or fail of the LED strip without counting. But software interrupts are often very slow, with varying delays, relative to the LED programming protocol, resulting in errors when trying to count LEDs or diagnose issues. One or more embodiments disclosed herein can remotely count serially connected LEDs (e.g., using the circuit configuration 200 illustrated in FIG. 2) without using software interrupts.

FIG. 1 illustrates example self-checkout lanes including serially connected strips of LEDs, according to one embodiment. A retail environment 100 includes one or more customers 102 and a checkout area 110. The customers 102 can select a manned checkout lane 120A-N or a self-checkout lane 130A-N to use for checkout.

Each manned checkout lane 120A-N includes at least one strip of LEDs. For example, the manned checkout lane 120A includes an LED strip 122. The LED strip 122 is made up of multiple LEDs, connected serially. In an embodiment, the manned checkout lane 120A can include multiple strips of LEDs, each strip including LEDs connected serially.

For example, the LED strip 122 can include one or more guidance lights to assist customers and employees with the checkout process. The LED strip 122 can include a lane light indicating the status of the lane or POS system (e.g., with a color indicating whether the lane is open, the POS is active, etc.). The LED strip 122 can further include lights indicating a receipt printer, coupon slot, cashback return, or other components of the POS system. In an embodiment, one or more of the lights in the LED strip 122 can be animated (e.g., to draw customer attention). These are merely examples, and other LEDs can be used.

In an embodiment, each manned checkout lane 120A-N includes a controller. For example, the manned checkout lane 120A includes a controller 124. In an embodiment, the controller 124 can be used for counting the LEDs in the LED strip 122 (e.g., as discussed in FIGS. 2-5, below). Alternatively, the manned checkout lanes 120A-N can share a controller. For example, all of the manned checkout lanes 120A-N can share a controller. Alternatively, several (but not all) of the manned checkout lanes 120A-N can share a controller.

Each self-checkout lane 130A-N also includes at least one strip of LEDs. For example, the self-checkout lane 130A includes an LED strip 132. The LED strip 132 is made up of multiple LEDs, connected serially. In an embodiment, the self-checkout lane 130A can include multiple strips of LEDs, each strip including LEDs connected serially. Further, as discussed above for the LED strip 122, the LED strip 132 can include one or more guidance lights or other LEDs to assist customers and employees with the checkout process.

In an embodiment, a controller is used with the self-checkout lanes 130A-F. For example, a controller 134 can be used with all of the self-checkout lanes 130A-N. In an embodiment, the controller 134 can be used for counting the LEDs in the LED strip 132 (e.g., as discussed in FIGS. 2-5, below). Alternatively, each self-checkout lane 130A-N can include its own controller. As another alternative, several (but not all) of the self-checkout lanes 130A-N can share a controller.

The checkout area 110 is connected with an administration system 150 using a communication network 140. In an embodiment, the communication network 140 can be any suitable communication network, including a local area network (LAN), wide area network (WAN), or the Internet. The checkout area 110 can connect with the communication network 140 using any suitable technology, including a wired connection, a WiFi connection, a Bluetooth™ connection, a cellular connection, or any other suitable connection.

For example, each manned checkout lane 120A-A can include a POS system with network components suitable to connect with the network 140. Similarly, the self-checkout lanes 130A-N can include POS systems with network components suitable to connect with the network 140. In an embodiment, each self-checkout lane 130A-N includes network components and connects with the network 140. Alternatively, the self-checkout lanes 130A-N share a central POS component with network components to connect with the network 140.

The administrative system 150 can be used to administer various aspects of the checkout area 110. For example, the administrative system 150 can be used to configure and troubleshoot the various POS components in each of the manned checkout lanes 120A-N and the self-checkout lanes 130A-N. In this example, the administration system 150 can be a back office system located in or near a retail store, a central office system, or any other suitable system.

Further, as discussed in more detail below, the administrative system can be used to request a count of LEDs in the LED strips 122 and 132, can receive the count, and can take an appropriate action after receiving the count. For example, the administration system 150 can run periodic diagnostics on the components of the checkout area 110 (e.g., the POS components). As part of these diagnostics, the administration system 150 can count LEDs in the LED strips 122 and 132 and take appropriate actions. For example, if the administration system 150 determines that an LED strip 122 or 132 includes an unexpected number of LEDs, the administration system can trigger an alarm, transmit an alert to an administrator, provide an alert to the relevant POS system, or take any other suitable action. In an embodiment, the administrative system 150 can be any suitable computer system. One example system is described in connection with FIG. 6, below.

Figure 2:
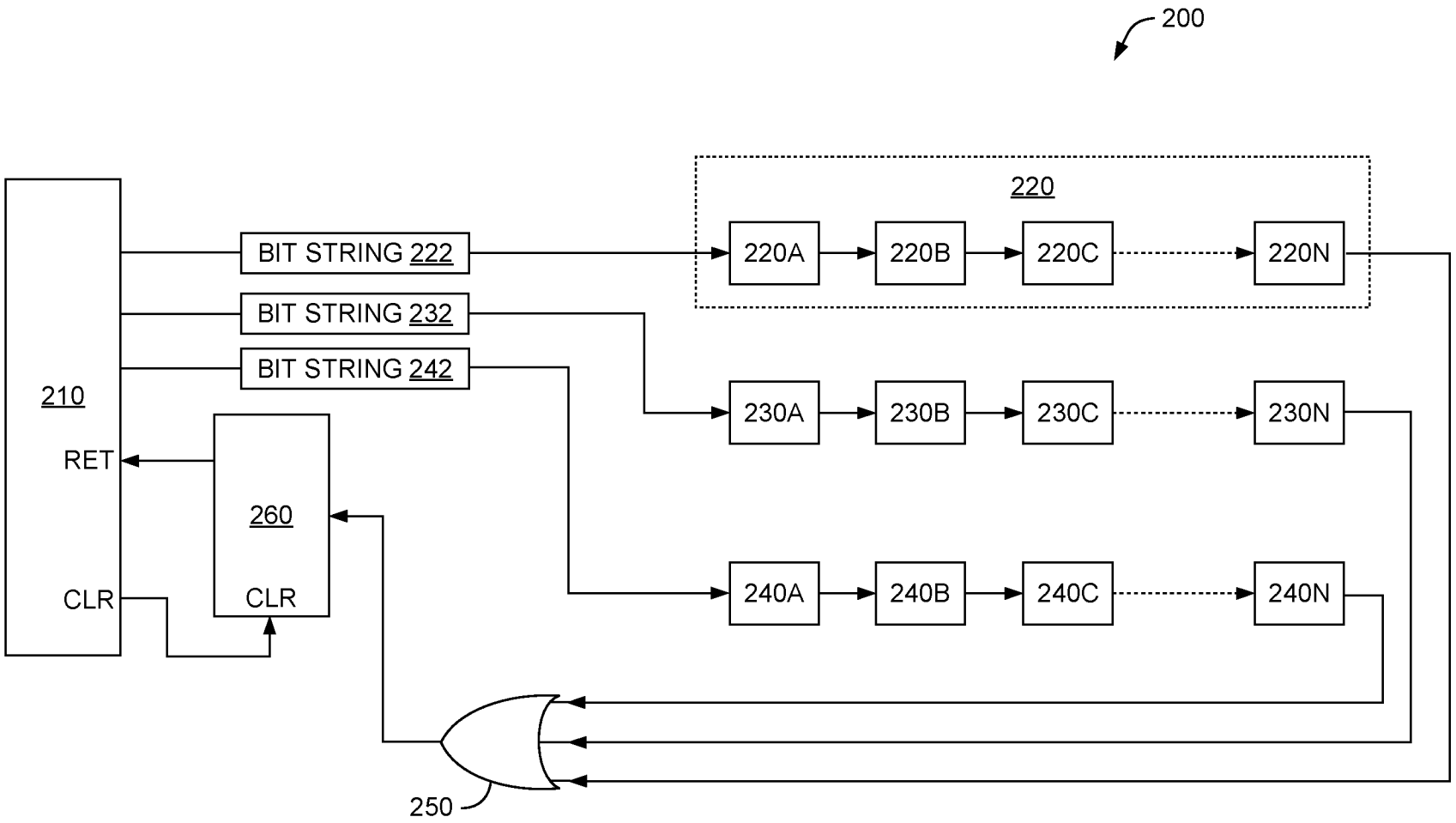
FIG. 2 illustrates strips of serially connected LEDs, according to one embodiment.

FIG. 2 illustrates strips of serially connected LEDs, according to one embodiment. A circuit configuration 200 includes a controller 210. The controller 210 is used to count the active LEDs in strips of serially connected LEDs. For example, as illustrated in FIG. 2, the controller 210 can count the active LEDs in three strips of serially connected LEDs: 220A-N, 230A-N, and 240A-N.

As discussed further below with regard to FIG. 4, in an embodiment each LED 220A-N, 230A-N, and 240A-N consumes a number of bits to program the parameters of the LED (e.g., the color). As illustrated, a the controller 210 can provide one bit string 222 to an LED 220A, another bit string 232 to another LED 230A, and another bit string 242 to another LED 240A. In an embodiment, each of the bit strings 222, 232, and 242 can have the same length (i.e., the same number of bits). Alternatively, the bit strings 222, 232, and 242 can have different lengths.

For example, each of the LEDs 220A-N can be a Red-Green-Blue-White (RGBW) LED, meaning the controller can program the Red tone, the Green tone, the Blue tone, and the White tone for each LED. Each tone consumes a particular number of bits to program the value for that tone. For example, assume each tone uses 8 bits to set its value. The controller 210 should transmit 32 bits to the LED 220A to program the color value for the LED 220A: 8 bits for Red, 8 bits for Green, 8 bits for Blue, and 8 bits for White. Similarly, the controller 210 should transmit 32 bits to the LED 220B to set the color value for the LED 220B, 32 bits to the LED 220C to set the color value for the LED 220C, etc.

In an embodiment, the LEDs 220A-N are connected serially. The controller 210 can set the color for all of the LEDs by transmitting a bit string 222 that includes 32 bits of data for each of the LEDs. That is, assume an LED strip 220 includes four LEDs 220A-D, including a first LED 220A coupled with the controller 210 and a last LED 220D coupled with a latch circuit 260 (via an OR gate 250).

The LEDs 220A-D are connected serially, and each requires 32 bits of data to set its color. The controller 210 can send a bit string 222 that is 128 bits long (i.e., 32 bits*4 LEDs). The first LED 220A consumes the first 32 bits, to program its color, and passes the remaining 96 bits to the second LED 220B. The LED 220B consumes the next 32 bits, and passes the remaining 64 bits to the third LED 220C. The LED 220C consumes the next 32 bits and passes the remaining 32 bits to the fourth LED 220D. The LED 220D consumes the last 32 bits, and the bit string 222 is empty. In an embodiment, this can be done for any number of bits per LED and any number of LEDs in the LED strip 220.

In an embodiment, as discussed further below with regard to FIG. 4, the controller 210 can determine the number of active LEDs in the LED strip 220 based on the number of bits included in the bit string 222, using an OR gate 250 and a latch circuit 260. In an embodiment, the controller 210 can identify when the LED strip 220 does not consume all of the bits in the bit string 222, based on when the latch circuit 260 is set to high.

For example, assume that the LED strip 220 includes three LEDs 220A-C, each of which consumes 32 bits. The controller 210 expects that that the LED strip 220 includes four LEDs, and so it sends 128 bits in the bit string 222 to set the color value for all four LEDs 220A-N. The LED strip 220 will only consume 96 bits (because it includes only 3 LEDS). The extra 32 bits will be transmitted to the OR gate 250 and the input of the latch circuit 260, setting the latch to high. This sets the RET value at the controller to high, and tells the controller that fewer than four LEDs are active in the LED strip 220. As discussed in further detail below with regard to FIG. 4, the controller 210 can use this as part of a search algorithm (e.g., a binary search algorithm) to identify the number of LEDs active in the LED strip 220.

Further, if the LED strip 220 includes an LED that is malfunctioning, not active (e.g., LED 220C), the failed LED will fail to communicate (e.g., fail to pass bits to the next LED in the strip). This will result in the latch circuit 260 always remaining low, no matter how many bits are sent to the LED strip 220. As discussed below with regard to FIG. 4, the controller 210 can use this to identify an error (e.g., by determining that the actual count is greater than the maximum possible count), and can signal an error.

In an embodiment, the OR gate 250 facilitates counting multiple strips of LED with a single controller 210 and latch 260. For example, the latch 260 can be a standard D flip-flop with its Q permanently set high. The latch 260 can have its state set to low by toggling the clear input (e.g., CLR as illustrated), and can be clocked to a high state by a feedback pulse through the OR gate 250 from any of the LED strips on the input side of the OR gate 250 (e.g., any of the LED strips 220A-N, 230A-N, and 240A-N). A feedback pulse through the OR gate 250 sets the latch high by toggling the latch clock. Since only one strip is tested at a time, the source of the latch state (e.g., which LED strip has triggered the latch being set to high) is known.

Figure 3:
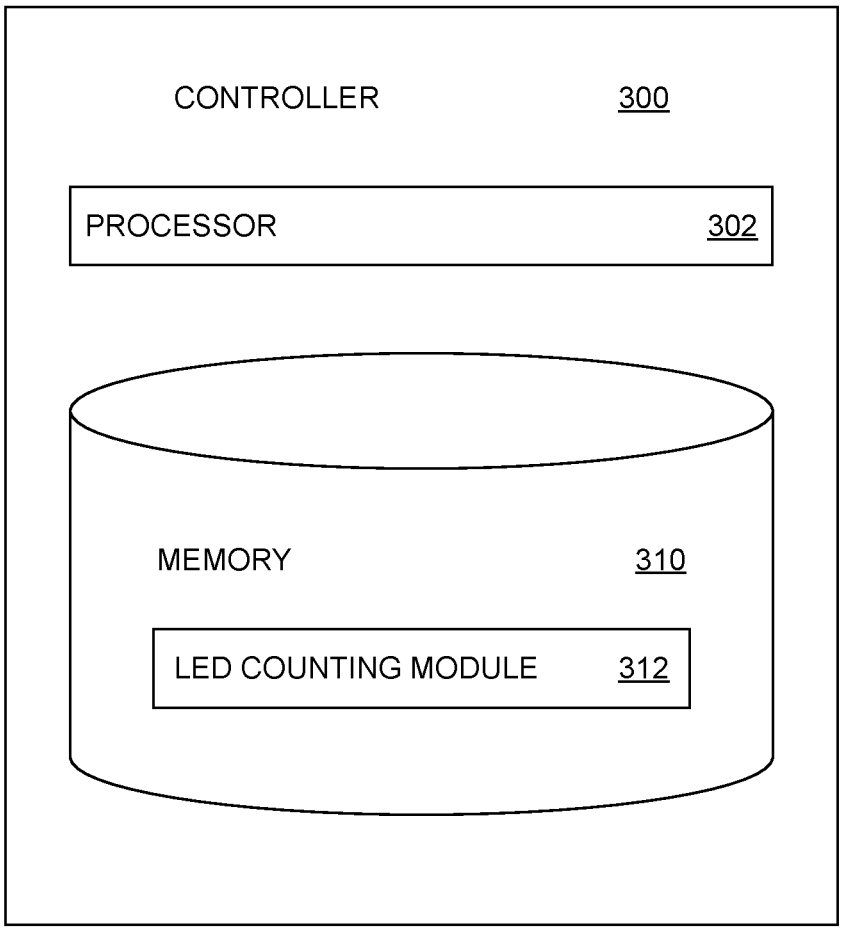
FIG. 3 illustrates a controller for remotely counting serially connected LEDs, according to one embodiment.

FIG. 3 illustrates a controller 300 for remotely counting serially connected LEDs, according to one embodiment. In an embodiment, the controller 300 can be used as the controller 210 illustrated in FIG. 2. The controller 300 includes a processor 302 and a memory 310. The processor 302 generally retrieves and executes programming instructions stored in the memory 310. In an embodiment, the controller 300 is a serial controller (e.g., a microcontroller with one or more General Purpose Input/Output (GPIO) pins). Alternatively, the processor 302 is included to be representative of a single central processing unit (CPU), multiple CPUs, a single CPU having multiple processing cores, graphics processing units (GPUs) having multiple execution paths, and the like. Further, the controller 300 can be a single controller, or can represent a collection of controllers (e.g., managed together).

Although the memory 310 is shown as a single entity, the memory 310 may include one or more memory devices having blocks of memory associated with physical addresses, such as random access memory (RAM), read only memory (ROM), flash memory, or other types of volatile and/or non-volatile memory. The memory 310 generally includes program code for performing various functions related to use of the controller 300. The program code is generally described as various functional "applications" or "modules" within the memory 310, although alternate implementations may have different functions and/or combinations of functions. The memory 310 includes an LED counting module 312. In an embodiment, this LED counting module 312 can be used to count LEDs in a serially connected LED strip, as illustrated in FIGS. 4-5.

Figure 4:
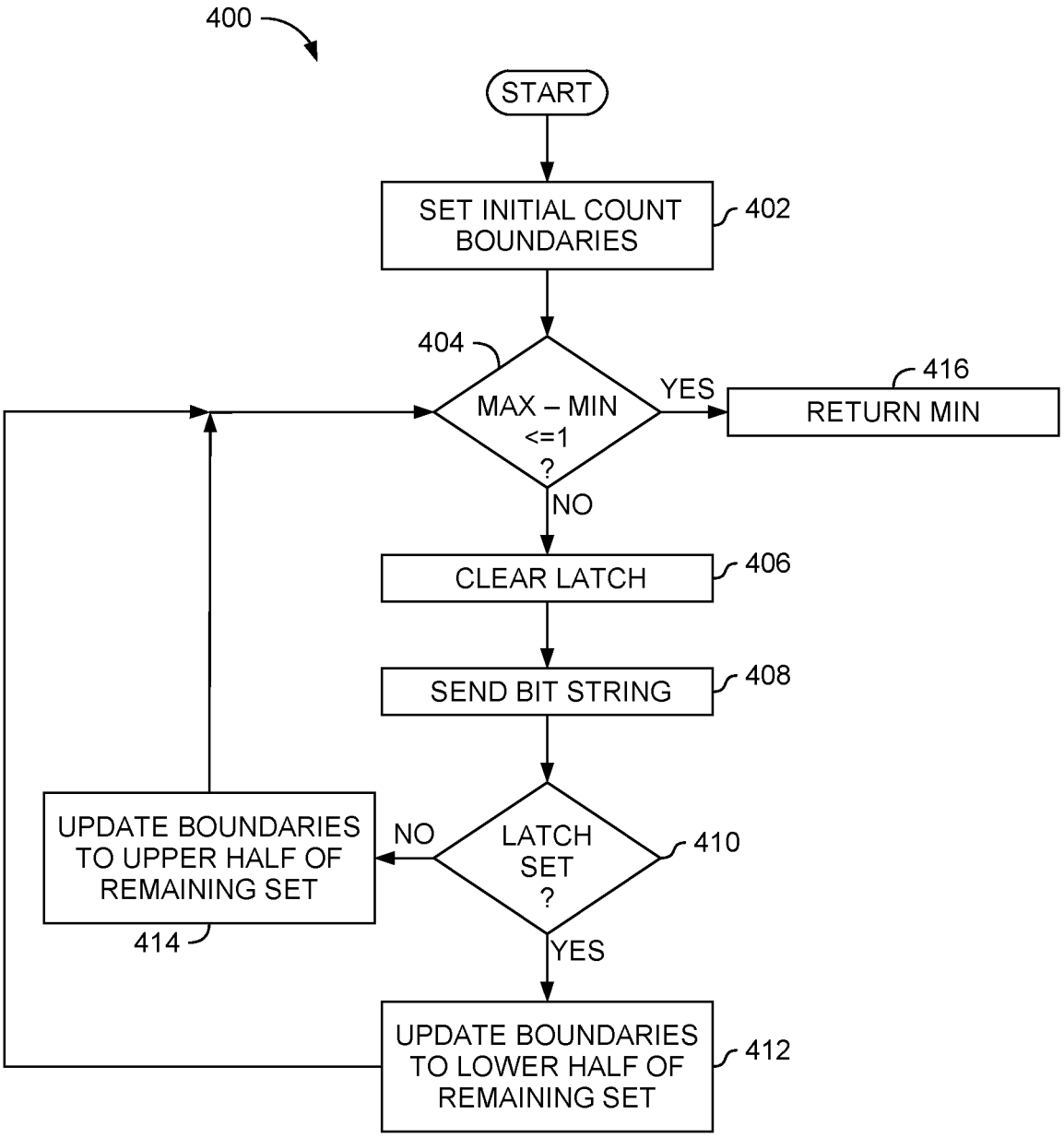
FIG. 4 is a flowchart illustrating remotely counting serially connected LEDs, according to one embodiment.
Figure 5:
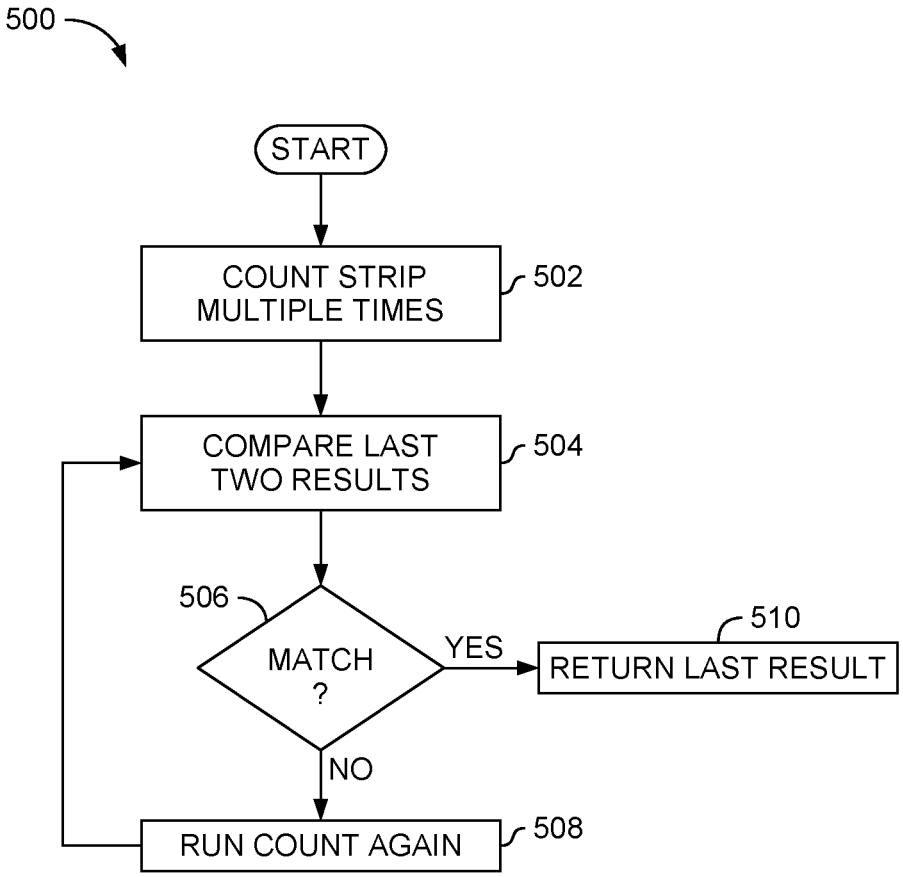
FIG. 5 is a further flowchart illustrating remotely counting serially connected LEDs, according to one embodiment.

FIG. 4 is a flowchart 400 illustrating remotely counting serially connected LEDs, according to one embodiment. In an embodiment, an LED counting module (e.g., the LED counting module 312 illustrated in FIG. 3) uses a circuit (e.g., the circuit configuration 200 illustrated in FIG. 2) to count serially connected LEDs. In an embodiment, as illustrated in FIG. 4, a binary search technique can be used by the LED counting module with the circuit to remotely count the serially connected LEDs. Alternatively, another suitable search technique (i.e., instead of or in addition to a binary search) can be used.

At block 402, the LED counting module sets the initial count boundaries. In an embodiment, this includes setting a MIN value, a MAX value, and a MIDPOINT value. The MIN value can be set to 0, the MAX value can be set to a value higher than the expected number of LEDs, and the MIDPOINT can be set to half of the MAX+MIN value.

As an example, assume that the LED counting module is operating using the controller 210 illustrated in FIG. 2, counting the LED strip 220, which could have a maximum of 100 LEDs but actually has 25 active LEDs. At block 402 the MIN value can be set to 0, the MAX value can be set to 101 (one more than 100) and the MIDPOINT can be set to 50 (MAX−MIN divided by 2). In an embodiment, MAX, MIN and MIDPOINT are always integer values and any division is rounded to the floor value (e.g., rounded down).

At block 404, the LED counting module determines whether MAX−MIN is less than or equal to 1. Continuing the example above, MAX is set to 101 and MIN is set to 0. Thus, MAX−MIN is equal to 101. This is greater than 1, so the flow proceeds to block 406.

At block 406, the LED counting module clears the latch (e.g., sets the value low). For example, in the circuit configuration 200, the controller 210 can set the value of the latch circuit 260 low.

At block 408, the LED counting module sends a bit string that is sufficient to provide bits to MIDPOINT number of LEDS. Following the example above, MIDPIONT is 50. Assume each LED in the LED strip 220 consumes 32 bits (e.g., for a RGBW LED that uses 8 bits for each tone, as discussed above with regard to FIG. 2). The LED counting module sends a bit string (e.g., a bit string 222 as illustrated in FIG. 2) with 1,600 (50*32) bits.

As discussed above, the LED strip 220 includes 25 LEDs, so it consumes 800 (25*32) bits. This leaves 800 unconsumed bits. Because the bit string includes unconsumed bits, as discussed above with regard to FIG. 2, the input to the OR gate 250 in FIG. 2 pulses high, the output of the OR gate 250 also pulses high, and the latch circuit 260 is set high by the input pulse from the OR gate cycle.

At block 410, the LED counting module determines whether the latch is set to high. Here, it is, so the flow proceeds to block 412.

At block 412, the LED counting module updates the counting boundaries to the lower half of the remaining search set. In an embodiment, this means setting the MAX equal to the prior MIDPOINT, and setting the MIDPOINT to the lower quartile: floor(MIN+MIDPOINT)/2. In our example, MAX is set to 50 (the prior MIDPOINT) and MIDPOINT is set to 25 ((0+50)/2).

The flow then returns to block 404. MAX is now 50, MIN is still 0, and MIDPOINT is 25. MAX−MIN is 50, still greater than 1, so the flow proceeds to block 406. At block 406 the LED counting module again clears the latch.

At block 408, the LED counting module sends a bit string sufficient for MIDPOINT number of LEDs to consume: 800 (25*32) bits. As discussed above the LED strip 220 includes 25 LEDs, so the LED strip 220 consumes all 800 bits. This means no bits are leftover, the input to the OR gate 250 is low and, assuming the other inputs are also low, the input to the latch circuit 260 is low.

At block 410, the LED counting module determines that the latch is not set (e.g., it is low). The flow proceeds to block 414.

At block 414, the LED counting module sets the counting boundaries to the upper half of the remaining search set. In an embodiment the LED counting module sets the MIN to the prior MIDPOINT and sets the MIDPOINT to (MAX+MIDPOINT)/2. Here, the LED counting module sets the MIN to 25 and sets the MIDPOINT to 37.

The flow returns to block 404. MAX is still 50. MIN is now 25. And MIDPOINT is 37. MAX−MIN is 25, still greater than 1, so the flow proceeds to block 406. At block 406, the LED counting module clears the latch (e.g., sets it to low).

At block 408, the LED counting module sends a bit string sufficient for MIDPOINT LEDs: 1184 (37*32). The LED strip 220 consumes only 800 bits (25*32), so the OR gate 250 is high, the input to the latch circuit 260 is high, and the latch is set to high at the next clock cycle.

At block 410, the LED counting module determines that the latch is set to high, so the flow proceeds to block 412. At block 412 the LED counting module updates the MAX to the prior MIDPOINT and the MIDPOINT to halfway between the prior MIN and the prior midpoint (MIN+MIDPOINT)/2. MAX is set to 37 and MIDPOINT is set to 31.

The flow again returns to block 404. MAX is now 37, MIN is still 25, and MIDPOINT is now 31. MAX-MIN is greater than 1, so the flow continues to iterate. After the next iteration, at block 412 the LED counting module sets MAX to 31, sets MIDPOINT to 28, and MIN remains 25. The MAX-MIN is still greater than 1, so the flow iterates again. This time at block 412 the LED counting module sets MAX to 28, sets MIDPOINT to 26, and MIN remains 25. Again, MAX-MIN is greater than 1, so the flow iterates again. This time at block 412 the LED counting module sets MAX to 26, sets MIDPOINT to 25, and MIN remains 25.

The flow returns to block 404. MAX is 26, MIDPOINT is 25, and MIN is 25. MAX−MIN (26−25) is now 1. So the flow proceeds to block 416.

At block 416, the LED counting module returns the value of MIN. Here, MIN is 25, so 25 is returned as the count for the number of LEDs in the LED strip 220. As discussed above, in this example, this is accurate.

Further, the techniques illustrated in FIG. 4 can be used to identify a malfunctioning or inactive LED in the LED strip. An inactive LED will not pass bits on to the next LED in the strip, meaning that the latch (e.g., the latch 260 illustrated in FIG. 2) is always low, regardless of how many bits are passed to the LED strip. Thus, if the final count (e.g., the end result of block 414) is higher than the known MAX number of LEDs in the strip, the controller can determine that an error occurred and can take appropriate action (e.g., providing an alert or error message to a system administrator).

FIG. 5 is a further flowchart for remotely counting serially connected LEDs, according to one embodiment. In an embodiment, a latch (e.g., the latch circuit 260 illustrated in FIG. 2) can be somewhat noisy. This can result in the latch being set incorrectly to high. To avoid this, the binary search techniques illustrated in the flowchart 400 of FIG. 4 (or other suitable search techniques) can be run multiple times to avoid false positives.

At block 502, an LED counting module (e.g., the LED counting module 312 illustrated in FIG. 3) counts the relevant LED strip multiple times. For example, assuming the controller 210 in FIG. 2 is being used to count the number of LEDs in the LED strip 220. The algorithm illustrated in flowchart 400 can be run multiple times to count the number of LEDS. For example, at block 502 the LED counting module can count the LEDs in the LED strip 220 twice.

At block 504, the LED counting module compares the last two results. At block 506, the LED counting module determines whether the last two results match. If they match, the flow proceeds to block 510 and the LED counting module returns the last result.

If the last two results do not match, the flow proceeds to block 508. At block 508, the LED counting module runs the algorithm illustrated in the flowchart 400 again, and then returns to block 504 and then proceeds to block 506 to check whether the results now match. If so, the flow proceeds to block 510 and returns the last result.

Figure 6:
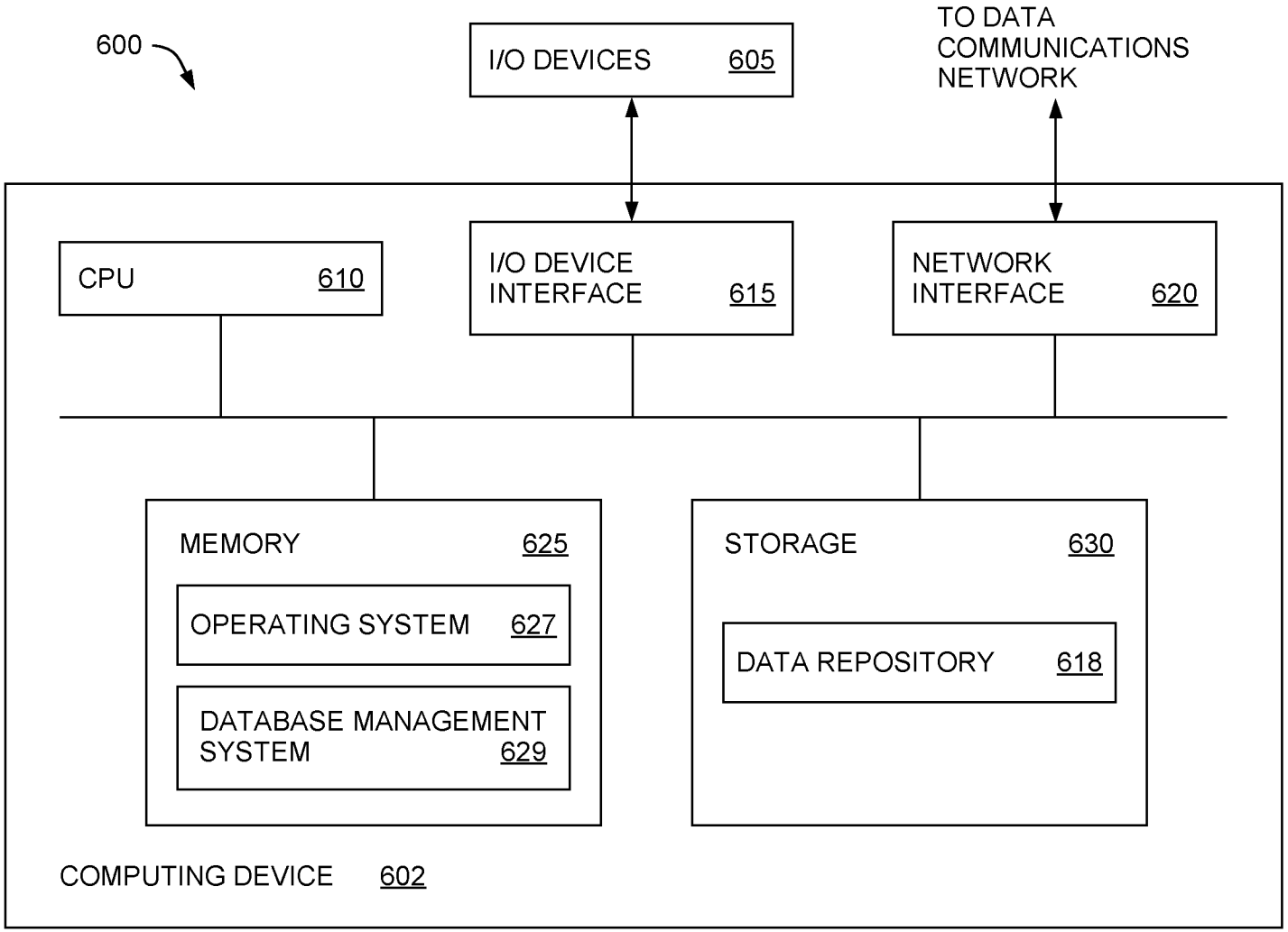
FIG. 6 is a block diagram illustrating a computing environment, according to an embodiment.

FIG. 6 is a block diagram illustrating a computing environment 600, according to an embodiment. As shown, computing device 602 includes, without limitation, a central processing unit (CPU) 610, a network interface 620, a memory 625, and storage 630, each connected to a bus 640. In an embodiment, the computing device 602 is the administrative system 150 illustrated in FIG. 1. Alternatively, or in addition, the computing device 602 is the controller 300 illustrated in FIG. 3. The computing device 602 also includes an I/O device interface 615 for connecting to I/O devices 605 (e.g., keyboard, display and mouse devices) in the environment 600. Further, in context of this disclosure, the computing elements shown in the computing device 605 may correspond to a physical computing system or may be a virtual computing instance executing within a computing cloud.

CPU 610 retrieves and executes programming instructions stored in memory 625 as well as stores and retrieves application data residing in the storage 630. For example, the CPU 610 can correspond with the processor 302 illustrated in FIG. 3, the memory 625 can correspond with the memory 310 illustrated in FIG. 3, and the CPU 610 can execute the LED counting module illustrated in FIG. 3. The bus 640 is used to transmit programming instructions and application data between CPU 610, I/O devices interface 605, storage 630, network interface 620, and memory 625. Note, CPU 610 is included to be representative of a single CPU, multiple CPUs, a single CPU having multiple processing cores, and the like. Memory 625 is generally included to be representative of a random access memory. Storage 630 may be a disk drive storage device. Although shown as a single unit, storage 630 may be a combination of fixed and/or removable storage devices, such as fixed disc drives, removable memory cards, network attached storage (NAS), or a storage area-network (SAN).

Illustratively, memory 625 includes an operating system 627 and a database management system (DBMS) 629, while storage 630 includes a data repository 618 (e.g., a database). Further, as discussed above, the memory 625 can include the additional modules described above with regard to FIG. 3. The operating system 627 generally controls the execution of application programs on the computing device 605. Examples of operating system 627 include, without limitation, versions of UNIX, distributions of the Linux® operating system, versions of Microsoft® Windows® and so on. The DBMS 629 generally facilitates the capture and analysis of data in the data repository. For instance, the DBMS 629 could enable the definition, creation, querying, update and administration of the data repository 618. As an example, the DBMS 629 could receive a query (e.g., composed using Structured Query Language (SQL) and, in response, could generate an execution plan that includes one or more access routines to be run against the data repository 618. The DBMS 629 could then execute the access routine(s) and could return any query result data to the requestor.

One or more of the embodiments discussed above generally relate to counting LEDs in a serially connected strip of LEDs. This is merely one example. One or more the techniques disclosed herein could be used to count or monitor serially connected electronic components for a variety of applications, including security systems, or the suitable systems.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

In the following, reference is made to embodiments presented in this disclosure. However, the scope of the present disclosure is not limited to specific described embodiments. Instead, any combination of the following features and elements, whether related to different embodiments or not, is contemplated to implement and practice contemplated embodiments. Furthermore, although embodiments disclosed herein may achieve advantages over other possible solutions or over the prior art, whether or not a particular advantage is achieved by a given embodiment is not limiting of the scope of the present disclosure. Thus, the following aspects, features, embodiments and advantages are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

Aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system."

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Embodiments of the invention may be provided to end users through a cloud computing infrastructure. Cloud computing generally refers to the provision of scalable computing resources as a service over a network. More formally, cloud computing may be defined as a computing capability that provides an abstraction between the computing resource and its underlying technical architecture (e.g., servers, storage, networks), enabling convenient, on-demand network access to a shared pool of configurable computing resources that can be rapidly provisioned and released with minimal management effort or service provider interaction. Thus, cloud computing allows a user to access virtual computing resources (e.g., storage, data, applications, and even complete virtualized computing systems) in "the cloud," without regard for the underlying physical systems (or locations of those systems) used to provide the computing resources.

Typically, cloud computing resources are provided to a user on a pay-per-use basis, where users are charged only for the computing resources actually used (e.g. an amount of storage space consumed by a user or a number of virtualized systems instantiated by the user). A user can access any of the resources that reside in the cloud at any time, and from anywhere across the Internet. In context of the present invention, a user may access applications (e.g., the administration system 150 illustrated in FIG. 1) or related data available in the cloud. For example, the administration system 150 could execute on a computing system in the cloud. Doing so allows a user to access this information from any computing system attached to a network connected to the cloud (e.g., the Internet).

While the foregoing is directed to embodiments of the present invention, other and further embodiments of the invention may be devised without departing from the basic scope thereof, and the scope thereof is determined by the claims that follow.

What is claimed is:

1. A method comprising:

transmitting a first plurality of bits from a controller to a first programmable light emitting diode (LED) of a plurality of serially connected programmable LEDs, the plurality of serially connected programmable LEDs comprising the first programmable LED coupled to the controller and a last programmable LED coupled to a latch circuit;

determining, using the controller, that the latch circuit is set, wherein the latch circuit is set based on an output of the last programmable LED after the transmitting the first plurality of bits;

identifying a first number of active programmable LEDs in the plurality of serially connected programmable LEDs based on the determining that the latch circuit is set;

identifying a second number of active programmable LEDs in the plurality of serially connected programmable LEDs; and determining that the second number of active programmable LEDs does not match the first number of active programmable LEDs, and in response determining a third number of active programmable LEDs in the plurality of serially connected programmable LEDs.

2. The method of claim 1, wherein a length of the first plurality of bits is based on an expected number of programmable LEDs in the plurality of serially connected programmable LEDs and a number of bits used to program each programmable LED in the plurality of serially connected programmable LEDs.

3. The method of claim 2, wherein the first plurality of bits comprises more bits than are used to program the expected number of programmable LEDs in the plurality of serially connected programmable LEDs, the method further comprising:

transmitting at least one bit of the first plurality of bits from the last programmable LED to the latch circuit, wherein the latch circuit is set based on the at least one bit.

4. The method of claim 1, further comprising:

programming each programmable LED in the plurality of serially connected programmable LEDs by transmitting a second plurality of bits.

5. The method of claim 4, wherein programming each programmable LED in the plurality of serially connected programmable LEDs comprises programming a color for each programmable LED in the plurality of serially connected programmable LEDs by transmitting the second plurality of bits.

6. The method of claim 5, wherein the second plurality of bits comprises fewer bits than the first plurality of bits.

7. The method of claim 1, wherein the identifying the first number of active programmable LEDs comprises performing a binary search, and wherein the binary search comprises the transmitting the first plurality of bits and the determining, using the controller, that the latch circuit is set.

8. The method of claim 7, wherein the binary search further comprises transmitting a second plurality of bits from the controller to the first programmable LED, after transmitting the first plurality bits from the controller to the first programmable LED, wherein the second plurality of bits comprises fewer bits than the first plurality of bits.

9. The method of claim 1, wherein the last programmable LED is coupled to the latch circuit through an OR gate, the method further comprising:

transmitting a second plurality of bits from the controller to a second programmable LED of a second plurality of serially connected programmable LEDs, wherein the second plurality of programmable LEDs comprises the second programmable LED coupled to the controller and a third programmable LED coupled to the OR gate;

determining, using the controller, that the latch circuit is set, wherein the latch circuit is set based on an output of the OR gate after the transmitting the second plurality of bits; and identifying a second number of active programmable LEDs in the second plurality of serially connected programmable LEDs based on the determining that the latch circuit is set.

10. A system, comprising:

a plurality of serially connected programmable light emitting diodes (LEDs);

a latch circuit; and a controller comprising logic configured to perform an operation, the operation comprising:

transmitting a first plurality of bits from the controller to a first programmable LED of the plurality of serially connected programmable LEDs, the plurality of serially connected programmable LEDs comprising the first programmable LED coupled to the controller and a last programmable LED coupled to the latch circuit, wherein a length of the first plurality of bits is based on an expected number of programmable LEDs in the plurality of serially connected programmable LEDs and a number of bits used to program each programmable LED in the plurality of serially connected programmable LEDs;

determining, using the controller, that the latch circuit is set, wherein the latch circuit is set based on an output of the last programmable LED after the transmitting the first plurality of bits; and identifying a first number of programmable LEDs in the plurality of serially connected programmable LEDs based on the determining that the latch circuit is set.

11. The system of claim 10, wherein the first plurality of bits comprises more bits than are used to program the expected number of programmable LEDs in the plurality of serially connected programmable LEDs, the operation further comprising:

transmitting at least one bit of the first plurality of bits from the last programmable LED to the latch circuit, wherein the latch circuit is set based on the at least one bit.

12. The system of claim 10, the operation further comprising:

programming a color for each programmable LED in the plurality of serially connected programmable LEDs by transmitting a second plurality of bits, wherein the second plurality of bits comprises fewer bits than the first plurality of bits.

13. The system of claim 10, wherein the identifying the first number of active programmable LEDs comprises performing a binary search, and wherein the binary search comprises:

the transmitting the first plurality of bits;

the determining, using the controller, that the latch circuit is set; and transmitting a second plurality of bits from the controller to the first programmable LED, after transmitting the first plurality bits from the controller to the first programmable LED, wherein the second plurality of bits comprises fewer bits than the first plurality of bits.

14. The system of claim 10, further comprising:

an OR gate coupled to the latch circuit and the controller, wherein the last programmable LED is coupled to the latch circuit through the OR gate, and wherein the operation further comprises:

transmitting a second plurality of bits from the controller to a second programmable LED of a second plurality of serially connected programmable LEDs, wherein the second plurality of programmable LEDs comprises the second programmable LED coupled to the controller and a third programmable LED coupled to the OR gate;

determining, using the controller, that the latch circuit is set, wherein the latch circuit is set based on an output of the OR gate after the transmitting the second plurality of bits; and identifying a second number of active programmable LEDs in the second plurality of serially connected LEDs based on the determining that the latch circuit is set.

15. The system of claim 10, the operation further comprising:

identifying a second number of active programmable LEDs in the plurality of serially connected programmable LEDs; and determining that the second number of active programmable LEDs does not match the first number of active programmable LEDs, and in response determining a third number of active programmable LEDs in the plurality of serially connected programmable LEDs.

16. A computer program product for counting serially connected programmable light emitting diodes (LEDs), the computer program product comprising:

a computer-readable storage medium having computer-readable program code embodied therewith, the computer-readable program code executable by one or more computer processors to perform an operation, the operation comprising:

transmitting a first plurality of bits from a controller to a first programmable LED of a plurality of serially connected programmable LEDs, the plurality of serially connected programmable LEDs comprising the first programmable LED coupled to the controller and a last programmable LED coupled to a latch circuit through an OR gate;

determining, using the controller, that the latch circuit is set, wherein the latch circuit is set based on an output of the last programmable LED after the transmitting the first plurality of bits;

identifying a first number of active programmable LEDs in the plurality of serially connected programmable LEDs based on the determining that the latch circuit is set, transmitting a second plurality of bits from the controller to a second programmable LED of a second plurality of serially connected programmable LEDs, wherein the second plurality of programmable LEDs comprises the second programmable LED coupled to the controller and a third programmable LED coupled to the OR gate;

determining, using the controller, that the latch circuit is set, wherein the latch circuit is set based on an output of the OR gate after the transmitting the second plurality of bits; and identifying a second number of active programmable LEDs in the second plurality of serially connected programmable LEDs based on the determining that the latch circuit is set.

17. The computer program product of claim 16, wherein a length of the first plurality of bits is based on an expected number of programmable LEDs in the plurality of serially connected programmable LEDs and a number of bits used to program each programmable LED in the plurality of serially connected programmable LEDs.

18. The computer program product of claim 17, wherein the first plurality of bits comprises more bits than are used to program the expected number of programmable LEDs in the plurality of serially connected programmable LEDs, the operation further comprising:

transmitting at least one bit of the first plurality of bits from the last programmable LED to the latch circuit, wherein the latch circuit is set based on the at least one bit.

19. The computer program product of claim 16, wherein the identifying the first number of active programmable LEDs comprises performing a binary search, the binary search comprising:

the transmitting the first plurality of bits and the determining, using the controller, that the latch circuit is set; and transmitting a second plurality of bits from the controller to the first programmable LED, after transmitting the first plurality bits from the controller to the first programmable LED, wherein the second plurality of bits comprises fewer bits than the first plurality of bits.

20. The computer program product of claim 16, the operation further comprising:

identifying a second number of active programmable LEDs in the plurality of serially connected programmable LEDs; and determining that the second number of active programmable LEDs does not match the first number of active programmable LEDs, and in response determining a third number of active programmable LEDs in the plurality of serially connected programmable LEDs.

* * * * *